US007719550B2

(12) United States Patent
Lee et al.

(10) Patent No.: US 7,719,550 B2
(45) Date of Patent: May 18, 2010

(54) METHOD AND APPARATUS FOR ADJUSTING LUMINOSITY OF MONITOR BASED ON IMAGE

(75) Inventors: Hsin-Hung Lee, Fongshan (TW); Hsu-Hung Chen, Sanchung (TW); Yu-Hsiang Huang, Taipei Shien (TW)

(73) Assignee: Quanta Computer, Inc. (TW)

( * ) Notice: Subject to any disclaimer, the term of this patent is extended or adjusted under 35 U.S.C. 154(b) by 878 days.

(21) Appl. No.: 11/517,740

(22) Filed: Sep. 8, 2006

(65) Prior Publication Data

US 2007/0211083 A1 Sep. 13, 2007

(30) Foreign Application Priority Data

Mar. 10, 2006 (TW) ..... 95108265 A

(51) Int. Cl.
*G09G 5/10* (2006.01)

(52) U.S. Cl. ..... 345/690; 345/89

(58) Field of Classification Search ..... 345/89, 345/690

See application file for complete search history.

(56) References Cited

U.S. PATENT DOCUMENTS 6,414,664 B1 * 7/2002 Conover et al. ..... 345/89
2004/0201562 A1 * 10/2004 Funamoto et al. ..... 345/89

FOREIGN PATENT DOCUMENTS

TW 200423018 A 11/2004

* cited by examiner

*Primary Examiner*—Kevin M Nguyen
(74) *Attorney, Agent, or Firm*—Thomas, Kayden Horstemeyer & Risley, LLP.

(57) ABSTRACT

A method for deciding the maximum luminosity of a monitor is provided. The monitor is used for displaying a target image including a plurality of target pixels. Each of the target pixels has a target gray level. The target image and each adjacent image respectively has a maximum gray level. The monitor is capable of displaying M default gray levels. The method first generates a reference gray level (R) for the target image selectively based on the maximum gray levels. Then, a target control voltage corresponding to R is selected from a look-up table. A gain is generated based on R and M. Respectively multiplying each of the target gray levels by the gain can generate a plurality of new gray levels. At last, the method sets the target control voltage as the control voltage of the monitor and displays the target image with the new gray levels.

10 Claims, 3 Drawing Sheets

METHOD AND APPARATUS FOR ADJUSTING LUMINOSITY OF MONITOR BASED ON IMAGE

BACKGROUND OF THE INVENTION

1. Field of the Invention

The present invention relates to managing methods and managing apparatuses used in monitors, and in particular to methods and apparatuses for adjusting the luminosity of a monitor based on an image.

2. Description of the Prior Art

Generally, in an LCD monitor with a back light source, the luminosity of the light source is kept as a constant. The amount of light that passes through the liquid crystal molecules in the monitor is controlled by adjusting the rotation angles of the liquid crystal molecules. In this way, the brightness of the images displayed on the monitor can be changed. On the other hand, an image is composed of plural pixels having various gray levels (i.e. brightness). The rotation angle of one liquid crystal molecule is decided according to the gray level of the pixel corresponding to that liquid crystal molecule. In a monitor capable of displaying 256 gray levels, for example, gray level 255 corresponds to the highest brightness, and gray level 0 corresponds to the lowest brightness. Please refer to FIG. 1, which illustrates an example of the relationship between gray levels and brightness. As shown in this example, gray levels are directly proportional to the brightness of LCD monitors substantially.

In actual conditions, not every image includes pixels having gray level 255. In some images, the brightest pixel might only have gray level 200, or even lower. In prior arts, even the gray level of the brightest pixel in a displayed image is 200, the luminosity of the light source in the LCD monitor is still kept at the level capable of displaying gray level 255. Under this kind of condition, the luminosity of the light source is not adequately utilized. That is, lots of light is sheltered by rotated liquid crystal molecules. Therefore, when a darker image is displayed, the utility rate of the light source of an LCD monitor may be only 80%; the other 20% luminosity is not well utilized.

As known by those skilled in this art, the back light source of an LCD monitor consumes much power, for instance, 70%~80% power consumption among that of the LCD monitor. The higher luminosity a back light source has, the more power is consumed by the LCD monitor. Furthermore, when an LCD monitor is operated, the light source therein is always turned on. Obviously, this low utility problem of back light sources induces much unnecessary and undesired power consumption

SUMMARY OF THE INVENTION

To solve the aforementioned problem, this invention provides methods and apparatuses for adjusting the luminosity of a monitor based on an image. Taking the back light source in an LCD monitor as an example, the luminosity of the light source usually has a specific relationship with a control voltage. The methods and apparatuses, according to this invention, change the luminosity of LCD monitors through controlling the control voltage. In this invention, the luminosity of an LCD monitor is adaptively adjusted according to the level of luminosity actually needed by each image to be displayed. By contrast, the luminosity of an LCD monitor is always kept constant in prior arts. Hence, the utility rate of light sources can be considerably raised in this invention.

According to this invention, a monitor is assumed as capable of displaying M default gray levels, wherein M is a positive integer. The monitor is used for displaying a target image adjacent to N adjacent images in a video stream, wherein N is a positive integer, too. The target image and each of the N adjacent images respectively has a maximum gray level. The target image includes a plurality of target pixels; each of the target pixels has a target gray level.

One preferred embodiment, according to this invention, is a method for deciding a control voltage of the monitor. In this control method, a reference gray level (R) for the target image is first generated selectively based on the maximum gray levels. Then, a target control voltage corresponding to the reference gray level (R) is selected from a look-up table. Based on the reference gray level (R) and M, a gain is generated in this method. Respectively multiplying each of the target gray levels by the gain can generate a plurality of new gray levels for the target pixels in the target image. Finally, the method sets the target control voltage as the control voltage of the monitor and displays the target image with the new gray levels.

The other preferred embodiment, according to this invention, is an apparatus for deciding a control voltage of the monitor. The apparatus includes a generating module, a selecting module, a gain module, a multiplying module, and a setting module. The generating module is used for generating a reference gray level (R) for the target image selectively based on the maximum gray levels. The selecting module is used for selecting a target control voltage corresponding to the reference gray level (R) from a look-up table. The gain module is used for generating a gain based on the reference gray level (R) and M. The multiplying module is used for respectively multiplying each of the target gray levels by the gain to generate a plurality of new gray levels for the target pixels in the target image. The setting module is used for setting the target control voltage as the control voltage of the monitor and for displaying the target image with the new gray levels on the monitor.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
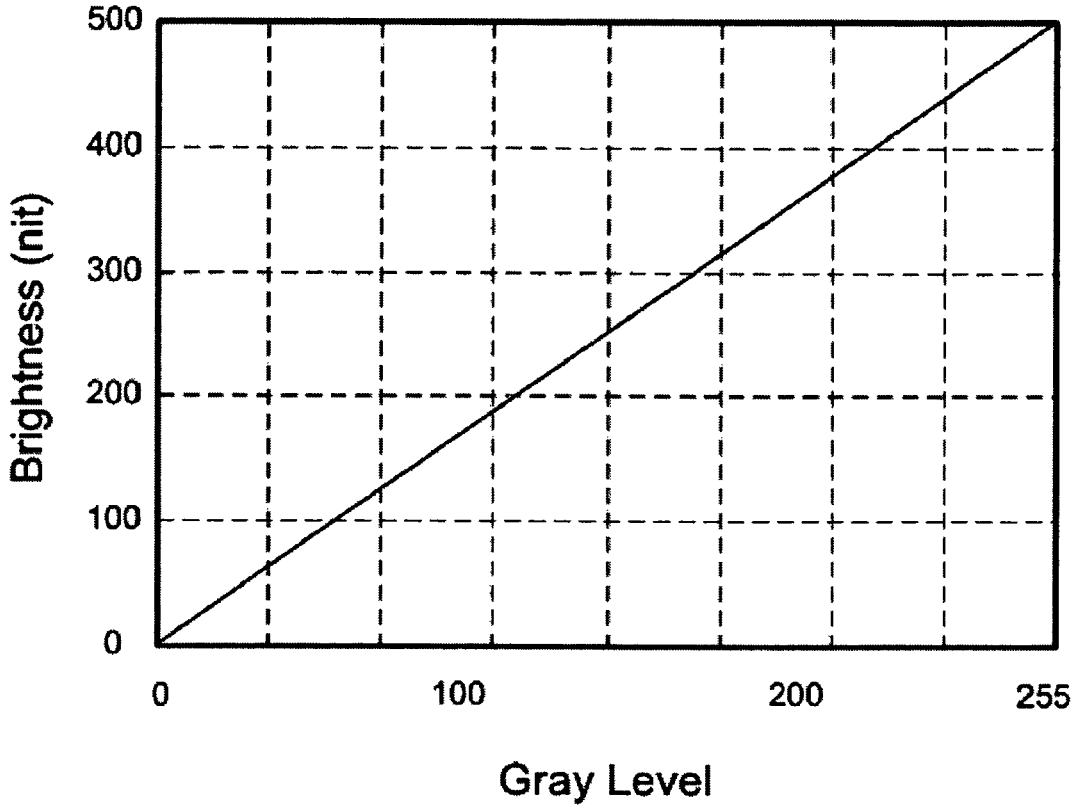
FIG. 1 illustrates an example of the relationship between gray levels and brightness.

This invention provides methods and apparatuses for adjusting the luminosity of a monitor based on an image.

Taking the back light source in an LCD monitor as an example, the luminosity of the light source usually has a specific relationship with a control voltage. The methods and apparatuses, according to this invention, change the luminosity of LCD monitors through controlling the control voltage.

The monitor is assumed to be used for displaying a target image adjacent to N adjacent images in a video stream, wherein N is a positive integer. For example, if N equals 32, the N adjacent images might be the 32 images previous to the target image in the video stream. The target image includes a plurality of target pixels, and each of the target pixels has a target gray level.

Besides, the target image and each of the N adjacent images respectively have a maximum gray level. The maximum gray levels can be generated through many different ways. For instance, the maximum gray level of a certain image may be the gray level with the highest brightness in the image. The maximum gray level may be the average value or a weighted average value of all the gray levels in the image as well. In some conditions, the maximum gray level may be a threshold statistically generated from the histogram of the gray levels in the image. That is, the histogram is integrated from low gray levels toward high gray levels. When the ratio of the integrated value to the whole area of the histogram reaches a predetermined value, the corresponding gray level can be set as the maximum gray level.

According to this invention, an instrument is first used to measure the brightness of a monitor corresponding to various gray levels under a fixed control voltage (for example, 5V). Subsequently, a look-up table of brightness and gray levels can be established based on the measured results. Please refer to Table 1, which shows an example of the look-up table.

TABLE 1

An example of the look-up table of brightness and gray levels

| Gray Level | Brightness |
|---|---|
| 131 | 259.16 |
| 135 | 266.29 |
| 139 | 273.71 |
| 143 | 280.75 |
| 147 | 288.26 |
| 151 | 295.30 |
| 155 | 303.19 |
| 159 | 310.13 |
| 163 | 317.74 |
| 167 | 324.97 |
| 171 | 332.77 |
| 175 | 339.71 |
| 179 | 347.60 |
| 183 | 354.83 |
| 187 | 362.73 |
| 191 | 369.95 |
| 195 | 377.85 |
| 199 | 384.79 |
| 203 | 392.87 |
| 207 | 399.91 |
| 211 | 407.61 |
| 215 | 414.37 |
| 219 | 421.69 |
| 223 | 428.54 |
| 227 | 435.10 |
| 231 | 443.09 |
| 235 | 450.13 |
| 239 | 457.83 |
| 243 | 467.15 |
| 247 | 477.52 |
| 251 | 488.74 |
| 255 | 505.38 |

The monitor is assumed as capable of displaying M default gray levels, wherein M is a positive number. Accordingly, the look-up table may include M corresponding relationships. In existing monitors, M usually equals 256. Table 1 is only an example, so not all possible corresponding relationships are listed.

Besides the relationships between brightness and gray levels, in the embodiments according to this invention, the relationships between brightness and various control voltages when gray level is set as 255 are also previously investigated. Please refer to Table 2, which shows an example of this look-up table.

TABLE 2

An example of the look-up table of brightness and control voltages

| Control Voltage | Brightness |
|---|---|
| 0.1 | 107.4 |
| 0.2 | 128.6 |
| 0.3 | 149.6 |
| 0.4 | 169.2 |
| 0.5 | 188.1 |
| 0.6 | 205.4 |
| 0.7 | 221.8 |
| 0.8 | 236.7 |
| 0.9 | 252 |
| 1 | 265.8 |
| 1.1 | 279.5 |
| 1.2 | 292 |
| 1.3 | 304.4 |
| 1.4 | 317.5 |
| 1.5 | 329.5 |
| 1.6 | 340.4 |
| 1.7 | 352.7 |
| 1.8 | 363.3 |
| 1.9 | 373.6 |
| 2 | 384 |
| 2.1 | 394.5 |
| 2.2 | 404.5 |
| 2.3 | 414.3 |
| 2.4 | 423.5 |
| 2.5 | 432.8 |
| 2.6 | 442.3 |

If the highest gray level in the target image is 175, from Table 1, it can be known that gray level 175 corresponds to brightness 339.71. That is, the highest brightness needed for displaying the target image is 339.71, instead of brightness 505.38 that corresponds to gray level 255. Subsequently, from Table 2, it can be known that gray level 255 corresponds to brightness 340.4 when the control voltage equals 1.6V. It can be seen that when the control voltage equals 1.6V, the highest brightness corresponding to gray level 255 is enough for displaying the target image.

The control methods and apparatuses, according to this invention, utilize the corresponding relationships described above. In this invention, a target control voltage can be set as 1.6V when displaying the target image; that is, the highest luminosity of the light source in the monitor is 340.4. Accordingly, the original highest brightness of the target image is maintained, and the highest luminosity of the light source in the monitor is decreased from 505.38 to 340.4. Thus, the power consumption of the light source is considerably reduced.

Besides setting the target control voltage, the target gray levels of the target pixels in the target image must be adjusted correspondingly according to this invention. For instance, the highest gray level 175 must be multiplied by a gain to be 255. Thus, the original highest brightness of the target image is actually maintained. Similarly, each of the target gray levels must be respectively multiplied by the gain to generate a plurality of new gray levels for the target pixels in the target image.

Figure 2:
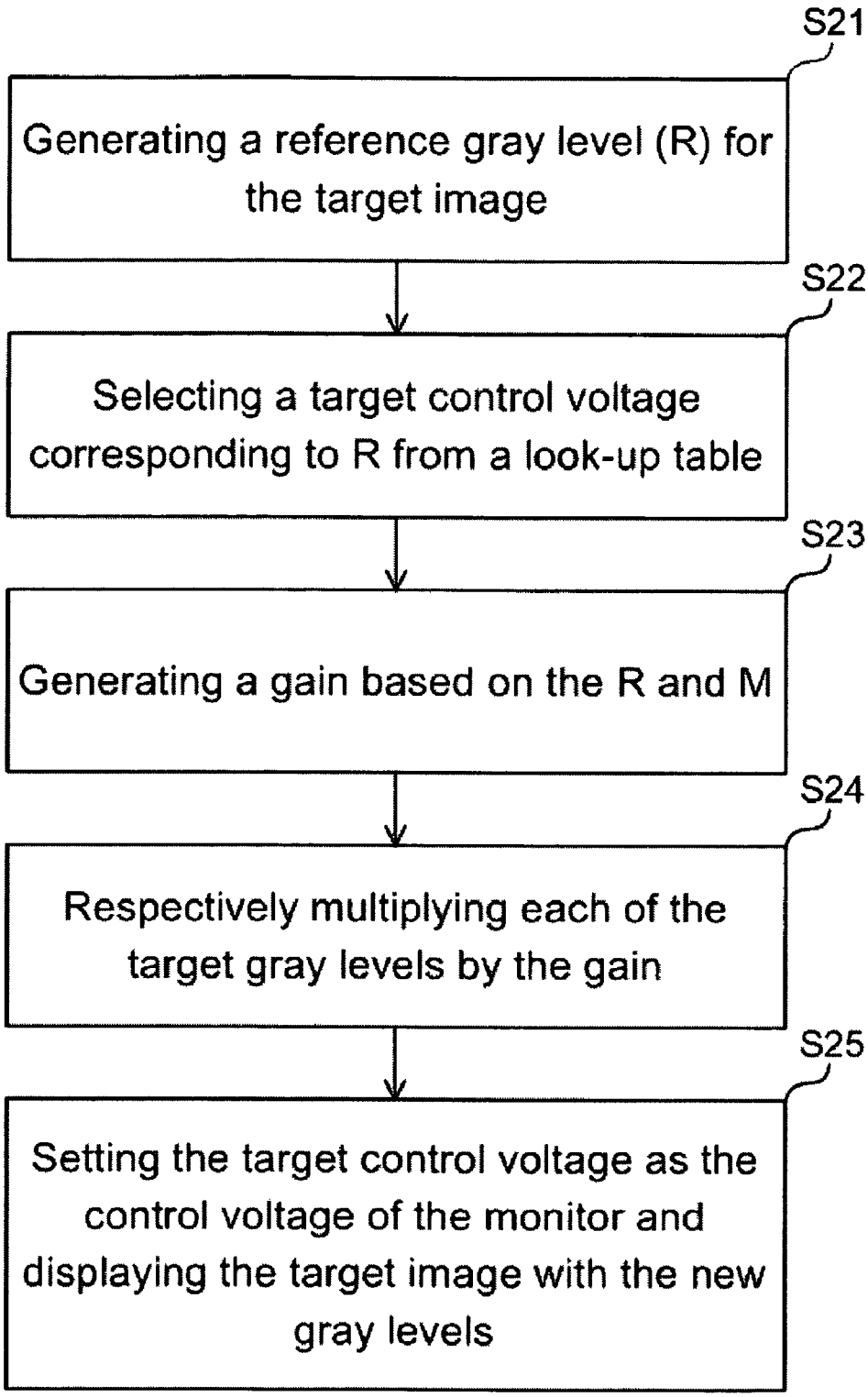
FIG. 2 illustrates the flowchart of the control method in the first preferred embodiment according to this invention.

The first preferred embodiment according to this invention is a method for deciding a control voltage of a monitor. Please refer to FIG. 2, which illustrates the flowchart of this method. In step S21, a reference gray level (R) for the target image is generated selectively based on the maximum gray levels of the target image and the N adjacent images. Next, in step S22, a target control voltage corresponding to the reference gray level (R) is selected from a look-up table. In step S23, a gain is generated based on the reference gray level (R) and M. Subsequently, in step S24, each of the target gray levels is respectively multiplied by the gain to generate a plurality of new gray levels for the target pixels in the target image. Finally, in step S25, the target control voltage is set as the control voltage of the monitor, and the target image is displayed with the new gray levels on the monitor.

If the gain equals the ratio of M to R, the gain in the aforementioned example is equal to (255/175). After being multiplied by the gain (255/175), the highest gray level is adjusted from 175 to 255. Similarly, each of the target gray levels must be respectively multiplied by (255/175), so that the corresponding ratios between the target gray levels can be maintained.

In actual application, the aforementioned look-up table can a single table integrated by Table 1 and Table 2. The look-up table stores plural sets of corresponding relationships between the reference gray level (R) and the target control voltage. Besides, the target control voltage can be a DC voltage or a pulse width modulation (PWM) square wave.

In an actual application, the reference gray level (R) might be the average value of the maximum gray levels of the N adjacent images instead of being the highest gray level in the target image. The target image may be interfered by noises so that the highest gray level in the target image becomes abnormally large or small. Therefore, using the average value of adjacent images can reduce the influence of noises and can prevent the brightness of the target image from abnormal changes accordingly. For instance, the reference gray level (R) of the target image may be the average value of the maximum gray levels of the 32 adjacent images previous to the target image.

Figure 3:
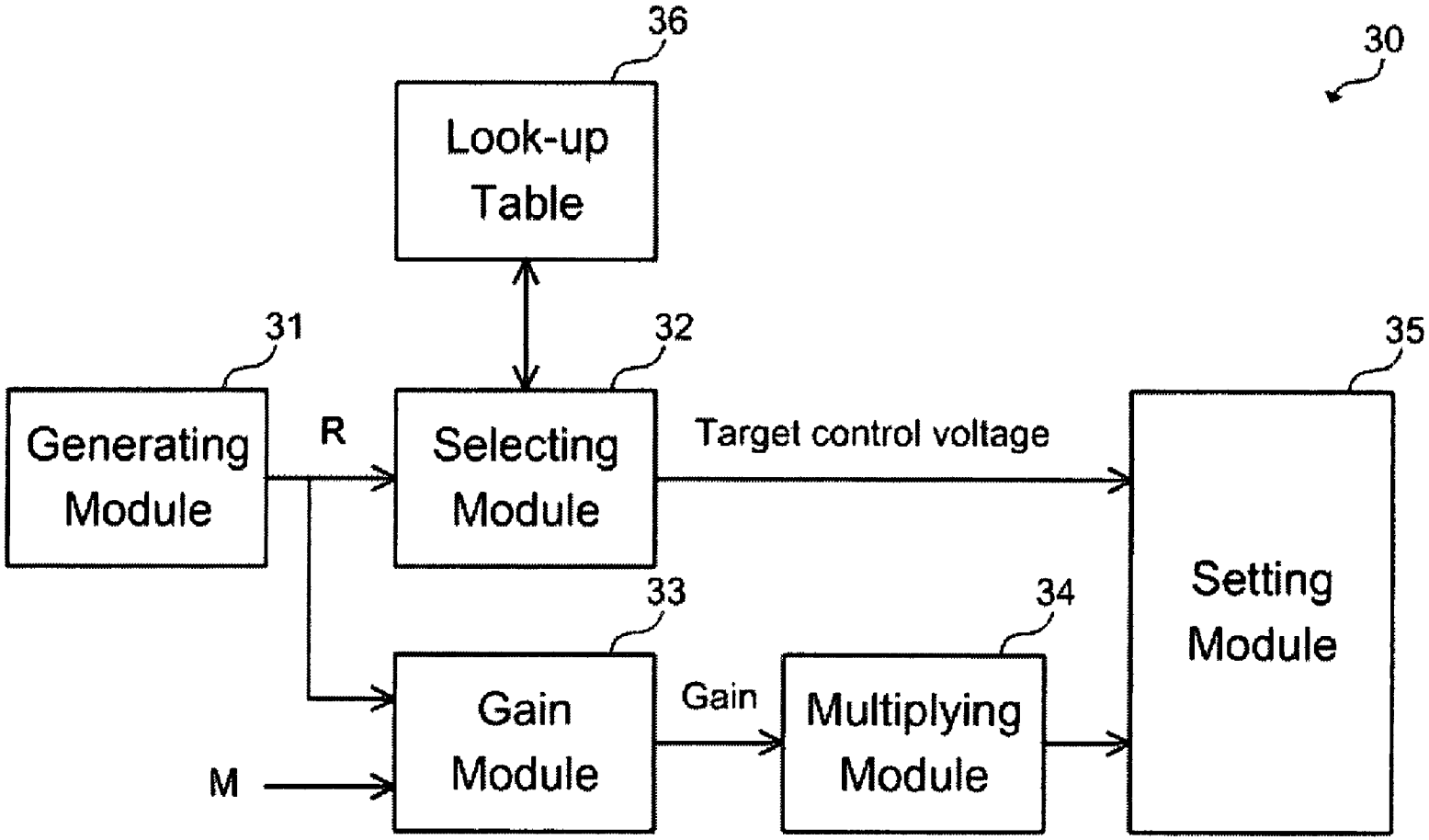
FIG. 3 illustrates the block diagram of the control apparatus in the second preferred embodiment according to this invention.

The second preferred embodiment, according to this invention, is an apparatus for deciding a control voltage of a monitor. FIG. 3 illustrates the block diagram of this control apparatus. The control apparatus 30 includes a generating module 31, a selecting module 32, a gain module 33, a multiplying module 34, and a setting module 35. The generating module 31 is used for generating a reference gray level (R) for the target image selectively based on the maximum gray levels. The selecting module 32 is used for selecting a target control voltage corresponding to the reference gray level (R) from a look-up table. The gain module 33 is used for generating a gain based on the reference gray level (R) and M. The multiplying module 34 is used for respectively multiplying each of the target gray levels by the gain to generate a plurality of new gray levels for the target pixels in the target image. The setting module 35 is used for setting the target control voltage as the control voltage of the monitor and for displaying the target image with the new gray levels on the monitor.

After the control voltage of the monitor is decreased, the original maximum brightness of the target image can still be maintained. Furthermore, the power consumption of the light source can be considerably reduced. Compared with prior arts, much unnecessary power consumption is saved in the monitors according to this invention. Besides, decreasing control voltages and luminosity of light sources lowers the temperature of monitors, so that the lifespan of monitors is extended.

As known by those skilled in this art, a gray level equal to zero does not mean the luminosity of a monitor is completely set as zero. That is to say, the leaking of light always exists. According to this invention, decreasing the highest luminosity of a light source can also reduce the amount of light that is leaked from the monitor. Therefore, the whole contrast of a displayed image is raised, because the maximum brightness of the image is constant, and the minimum brightness of the image is lowered.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method for deciding a control voltage of a monitor, said control voltage being relative to a maximum luminosity of the monitor, the monitor being used for displaying a target image adjacent to N adjacent images in a video stream, N being a positive integer, the target image and each of the N adjacent images respectively having a maximum gray level, the target image comprising a plurality of target pixels, each of the target pixels having a target gray level, the monitor being capable of displaying M default gray levels, M being a positive integer, said method comprising the steps of:

selectively generating a reference gray level (R) for the target image based on the maximum gray levels;

selecting a target control voltage corresponding to the reference gray level (R) from a look-up table;

generating a gain based on the reference gray level (R) and M;

respectively multiplying each of the target gray levels by said gain to generate a plurality of new gray levels for the target pixels in the target image; and setting the target control voltage as the control voltage of the monitor and displaying the target image with the new gray levels on the monitor.

2. The method of claim 1, wherein the gain is equal to (M/R).

3. The method of claim 1, wherein the monitor is an LCD monitor with a back light source.

4. The method of claim 1, wherein the target control voltage is a DC voltage or a pulse width modulation (PWM) square wave.

5. The method of claim 1, wherein the look-up table stores plural sets of corresponding relationships between the reference gray level (R) and the target control voltage.

6. An apparatus for deciding a control voltage of a monitor, said control voltage being relative to a maximum luminosity of the monitor, the monitor being used for displaying a target image adjacent to N adjacent images in a video stream, N being a positive integer, the target image and each of the N adjacent images respectively having a maximum gray level, the target image comprising a plurality of target pixels, each of the target pixels having a target gray level, the monitor being capable of displaying M default gray levels, M being a positive integer, said apparatus comprising:

a generating module for selectively generating a reference gray level (R) for the target image based on the maximum gray levels;

a selecting module for selecting a target control voltage corresponding to the reference gray level (R) from a look-up table;

a gain module for generating a gain based on the reference gray level (R) and M;

a multiplying module for respectively multiplying each of the target gray levels by the gain to generate a plurality of new gray levels for the target pixels in the target image; and a setting module for setting the target control voltage as the control voltage of the monitor and displaying the target image with the new gray levels on the monitor.

7. The apparatus of claim 6, wherein the gain is equal to (M/R).

8. The apparatus of claim 6, wherein the monitor is an LCD monitor with a back light source.

9. The apparatus of claim 6, wherein the target control voltage is a DC voltage or a pulse width modulation (PWM) square wave.

10. The apparatus of claim 6, wherein the look-up table stores plural sets of corresponding relationships between the reference gray level (R) and the target control voltage.

* * * * *